United States Patent [19]

Sedlmair

[11] Patent Number: 4,834,414

[45] Date of Patent: May 30, 1989

[54] TOE PIECE FOR SAFETY SKI-BINDING

[75] Inventor: Gerhard Sedlmair, Farchant, Fed. Rep. of Germany

[73] Assignee: Marker Deutschland GmbH, Eschenlohe, Fed. Rep. of Germany

[21] Appl. No.: 131,767

[22] Filed: Dec. 11, 1987

[30] Foreign Application Priority Data

Dec. 16, 1986 [DE] Fed. Rep. of Germany ... 8633618[U]

[51] Int. Cl.[4] ..... A63C 9/085

[52] U.S. Cl. ..... 280/625; 280/629; 280/634

[58] Field of Search ..... 280/625, 629, 634, 636

[56] References Cited

U.S. PATENT DOCUMENTS

| | | | |
|---|---|---|---|
| 3,787,070 | 1/1974 | Salomon | 280/629 |
| 3,854,741 | 12/1974 | Marker et al. | 280/625 |
| 3,902,730 | 9/1975 | Tschida et al. | 280/625 |
| 3,910,592 | 10/1975 | Sittmann | 280/625 |
| 4,660,849 | 4/1987 | Sedlmair et al. . | |
| 4,685,696 | 8/1987 | Sedlmair et al. . | |
| 4,728,117 | 3/1988 | Stepanek . | |
| 4,735,434 | 4/1988 | Sedlmair | 280/629 X |
| 4,735,435 | 4/1988 | Sedlmair | 280/625 |

FOREIGN PATENT DOCUMENTS

| | | | |
|---|---|---|---|
| 714441 | 7/1965 | Canada | 280/625 |
| 3612697 | 11/1986 | Fed. Rep. of Germany | 280/634 |
| 1372663 | 8/1964 | France | 280/629 |

*Primary Examiner*—Charles A. Marmor

*Assistant Examiner*—Tamara L. Finlay

*Attorney, Agent, or Firm*—D. Peter Hochberg; Mark M. Kusner; Louis J. Weisz

[57] ABSTRACT

A toe piece for holding a ski-boot in a safety ski binding, which toe piece is pivotable against a biasing force when excessive side forces occur. The toe piece includes a base plate and a pair of elongated, generally parallel side members, each of which is pivotally mounted at one end of the base plate. A coupling member pivotally connects the other ends of the side members to each other to form a linkage. The linkage is laterally movable relative to the base plate about the pivotally mounted ends of the side members. An assembly for centering the linkage is provided and includes a centering element, a tension spring acting on the centering element for biasing the element in a direction generally along the axis of the toe piece, a pair of locating pins in operative engagement with the centering element for limiting movement of the element in response to the tension spring and for centering the element relative to the toe piece, and a pin on the coupling member in operative engagement with the centering element to pivot the centering element about one locating pin when the linkage moves to one side of the toe piece and about the other locating pin when the linkage moves to the other side of the toe piece. The centering element is operable under influence of the tension means to return the linkage to a central position when no side forces are exerted thereon.

8 Claims, 1 Drawing Sheet

TOE PIECE FOR SAFETY SKI-BINDING

FIELD OF THE INVENTION

The present invention relates to a toe piece for a safety ski-binding, and more particularly to a safety ski-binding which is pivotable in a lateral direction against a biasing force when excessive side forces occur.

BACKGROUND OF THE INVENTION

The present invention generally relates to a toe piece of type disclosed in U.S. Pat. No. 4,685,696, the disclosure of which is expressly incorporated herein. This toe piece as compared to other known toe pieces of a similar kind, affords the advantage of exhibiting an improved restoring behavior because the friction characteristics of the device are more favorable. This and other toe pieces have the disadvantage that they include a relatively large number of internal parts, the manufacture of which is neither simple nor inexpensive. In addition, these parts are susceptible to icing, particularly owing to the presence of a compression spring acting thereon.

For this reason, it is an object of the present invention to improve and design a toe piece of the type heretofore described, and to provide a toe piece which is structurally simple, can be made at low cost, and will be effective and reliable in operation, particularly with respect to its susceptibility to icing.

Another object of the present invention is to provide a toe piece as defined above, which toe piece includes fewer and less complicated components than toe pieces known heretofore.

SUMMARY OF THE INVENTION

In accordance with the invention, there is provided a toe piece for holding a ski-boot in a safety ski-binding, which toe piece is pivotable against a biasing force when excessive side forces occur. the toe piece includes, a base plate and a pair of elongated, generally parallel side members, each of which is pivotally mounted at one end of the base plate. Coupling means pivotally connect the other ends of the side members to each other to form a linkage. The linkage is laterally movable relative to the base plate about the pivotally mounted ends of the side members. A pair of side boot holders are pivotally connected to the coupling means for laterally holding the sole of a boot. Means are provided for maintaining the side boot holders in a boot holding position when the linkage is within a predetermined distance from center and for allowing a side boot holder to move to a boot release position when the linkage moves beyond the predetermined distance from center. Means for centering the linkage are provided and include a centering element, tension means acting on the centering element for biasing the element in a direction generally along the axis of the toe piece, locating means in operative engagement with the centering element for limiting movement of the element in response to the tension means and for centering the element relative to the toe piece, and means on the connecting link in operative engagement with the centering element to pivot the element about the locating means in one direction when the linkage moves to one side of the toe piece and in a second direction when the linkage moves to the other side of the toe piece. The centering element is operable under influence of the tension means to return the linkage to a central position when no side forces are exerted thereon.

In accordance with a another aspect of the invention, the tension means is a helical spring connected to the centering element. In this respect, the centering element has a transverse slot into which the end of the tension spring is hooked. The slot is disposed on the side of the element adjacent the spring and is symmetrically enlarged near the center. The end of the tension spring moves within the slot as the centering element pivots about the locating means. Importantly, the slot is dimensioned such that outward pivotable movement of the centering element results in a shortening of the moment arm of the spring force acting thereon. Thus the force opposing outward pivotal movement of the centering element can be maintained approximately constant. To permit a change of the force required for a release of the toe piece, the helical tension spring may be connected by a screw mechanism to a member which is fixed to the ski so that the initial stress of the spring can be adjusted.

In accordance with another aspect of the present invention, the centering element includes forked prongs between which is defined a recess which is symmetrically enlarged in an inward direction. A pin on the connecting link is disposed in the recess between the prongs and is operative to rotate the centering element when the connecting link is moved laterally.

DRAWINGS

An illustrative embodiment of the present invention will now be described with reference to the accompanying drawings, in which:

FIG. 1 is a sectional elevation view of a toe piece illustrating a preferred embodiment of the present invention, FIG. 2 is a sectional plan view taken on line II—II in FIG. 1, and FIG. 3 is a view similar to FIG. 2 but showing the linkage in a shifted position.

DETAILED DESCRIPTION OF PREFERRED EMBODIMENT

Figure 1:
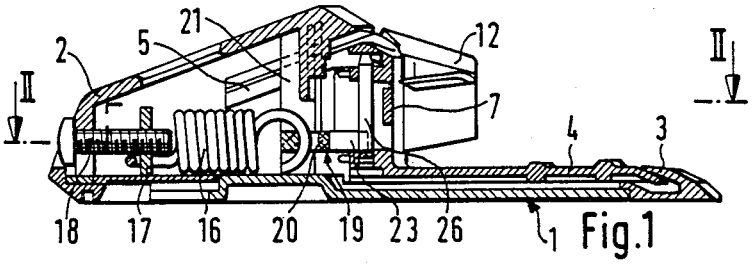

Referring not to the drawings wherein the showing is for the purpose of illustrating a preferred embodiment, and not for the purpose of limiting same, a toe piece according to a preferred embodiment of the present invention includes a housing having a base 1 which is to be secured to the ski and a cover 2 which is mounted on the base. As shown in the drawings, the base 1 extends to the right beyond the cover and at its free end defines a claw 3 for retaining the free end of a movable pedal 4. The structure disclosed heretofore is generally known, and in and of itself forms no part of the present invention.

The housing accommodates a linkage which is comprised of side members 5, 6 and a connecting link 7. Side members 5, 6 are movably mounted in the housing on pivot pins 8, 9, respectively, which pins 8, 9 are generally perpendicular to the plane of the ski. Pivot pins 10, 11 connect the link 7 to side members 5, 6. The pivot pins 10, 11 are parallel to the pivot pins 8, 9 and further carry respective side boot holder 12, 13. Means for controlling the side boot holders 12, 13 to release a skiing boot, are conventionally known and for that reason are not shown and described. FIG. 2 shows two screw holes 14 formed in the base 1 and two corresponding fixing holes 15 in the pedal 4 for mounting the toe piece to a ski. In the embodiment shown, pedal 4 is integral with the connecting link 7, as best seen in FIG. 1.

In accordance with the present invention, a helical tension spring 16 is provided, to be mounted on a retaining plate 17. The retaining plate 17 has internal screw threads into which the shank of a screw 18 is threaded. The head of screw 18 bears on the cover 2 and the retaining plate 17 is longitudinally movable in the housing in the direction of the shank of the screw to enable force adjustments as will be understood hereinafter. The active end of the helical tension spring 16 acts on a centering element 19, which includes a transverse slot 20 (see FIG. 2). Slot 20, on the side facing the spring 16, is symmetrically enlarged toward the center. Centering element 19 is generally symmetrical with respect to the longitudinal center plane of the toe piece. Under the influence of the helical tension spring 16, the centering element 19 normally bears on pins 21, 22. Pins 21, 22, which are fixed to the housing, are symmetrical to the longitudinal center plane of the toe unit and parallel to the pivots 8, 9. The centering element 19 has a forked end portion including prongs designated 24, 25 which form a recess 23. A coupling member 26 extends into the recess 23. Coupling member 26 is comprised of a pin which is secured to the link 7 at its center, and which pin is parallel to the pivot pins 10, 11. As is apparent from FIGS. 2 and 3, the recess 23 of the centering element 19 is symmetrically enlarged in an inward direction.

Figure 2:
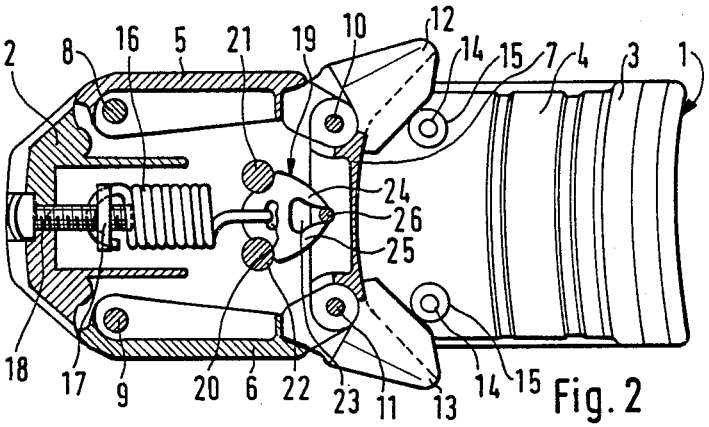

The preferred embodiment of toe piece is shown in its normal position in FIGS. 1 and 2. When a skiing boot, not shown, applies a force which overcomes the initial stress of the helical tension spring, the linkage will shift to the position shown in FIG. 3. The side boot holders 12, 13 do not move relative to connecting link 7 during the pivotal movement in the so-called elastic range. When the application of force is continued and the linkage moves beyond a predetermined distance from center, the skiing boot is released when the leasing side boot holder is opened under control of a release mechanism. As stated above, the release mechanism for controlling side boot holders 12, 13 is not subject matter of the present invention and therefore is not disclosed. As the force is reduced, the linkage returns to its initial position shown in FIG. 2.

Figure 3:
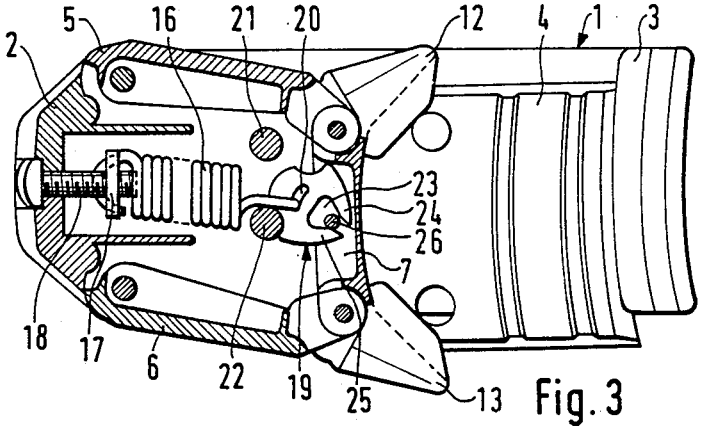

During the pivotal movement of the linkage, the pin 26 on connecting link 7 shift the centering element 19. Depending on the direction of the applied load, centering element 19 pivots about one of the pins 21, 22. During the pivotal movement of the centering element 19, the helical tension spring 16 is tensioned further. Owing to the described design of the slot 20, the outward pivotal movement results in a shortening of the moment arm of the spring force about pin 22, as seen in FIG. 3. Accordingly, the force which opposes the outward pivotal movement can be maintained at least approximately constant. With respect to centering element 19, the design of the recess 23 in the centering element 19 also affects the stress curve of the retaining force. In another respect, the additional free space defined by recess 23 prevents icing of the pin 26 therein.

The present invention has been described with respect to a preferred embodiment, modifications and alternations of which will occur to others upon their reading and understanding of this specification. It is intended that all such modifications and alterations be included insofar as they come within the scope of the appended claims or the equivalents thereof.

Having thus defined the invention, the following is claimed:

1. A toe piece for holding a ski-boot in a safety ski-binding, said toe piece being pivotable against a biasing force when excessive side forces occur, said toe piece comprising:

a base plate;

a pair of elongated, generally parallel side members, each pivotally mounted at one end on said base plate;

coupling means pivotally connecting the other ends of said side members to each other to form a linkage, said linkage being laterally movable relative to said base plate about said pivotally mounted ends of said side members;

a pair of side boot holders pivotally connected to said coupling means for laterally holding the sole of a boot;

means for centering said linkage including a centering element, tension means acting on said centering element for biasing said element generally along the axis of the toe piece toward the front thereof, locating means in operative engagement with said centering element for limiting movement of said element in response to said tension means and for centering said element relative to said toe piece, and means on said coupling means in operative engagement with said centering element to pivot said element about said locating means in one direction when said linkage means moves to one side of said toe piece and in a second direction when said linkage moves to the other side of said toe piece, said centering element being operable under influence of said tension means to return said linkage to a central position when no side forces are exerted thereon.

2. A toe piece as defined in claim 1 wherein, said locating means comprise two parallel pins symmetrically disposed on opposite sides of the axis of said toe piece, and said centering element includes arcuate surface portions engaging said pins, wherein said tension means act on said element between said pins such that said element is pivotal about said pins.

3. A toe piece as defined in claim 1 wherein said centering element includes an elongated transverse slot for connecting said element to said tensioning means, said slot having an enlarged central portion.

4. A toe piece as defined in claim 1 wherein, said centering element includes prongs defining a recess therebetween, and said means on said connecting link is a pin disposed in said recess.

5. A toe piece as defined in claim 1 wherein said tension means is adjustable.

6. A toe piece as defined in claim 5 wherein said tension means is a helical compression spring connected by a screw mechanism to said toe piece.

7. A toe piece for holding a ski-boot in a safety ski-binding said toe piece being pivotable against a biasing force when excessive side forces occur, said toe piece comprising:

a base plate;

a pair of elongated, generally parallel side members, each pivotally mounted at one end of said base plate;

coupling means pivotally connecting the other ends of said side members to each other to form a linkage, said linkage being laterally movable relative to said base plate about said pivotally mounted ends of said side members;

a pair of side boot holders pivotally connected to said coupling means for laterally holding the sole of a boot; and means for centering said linkage including:

two parallel pins symmetrically disposed on opposite sides of the axis of said toe piece, a centering element including first and second arcuate portions, each of said arcuate portions dimensioned to receive one of said parallel pins, tension means biasing said centering element generally longitudinally along the axis of said toe piece into engagement with said pins, and a coupling member on said coupling means in operative engagement with said centering element, said coupling member operable to pivot said centering element about one of said pins in one direction when said linkage means moves to one side of said toe piece and about the other of said pins in a second direction when said linkage moves to the other side of said toe piece, said centering element being operable under influence of said tension means to return said linkage to a central position when no side forces are exerted thereon.

8. A toe piece as defined in claim 7 wherein said centering element includes an elongated, transverse slot for connecting said element to said tensioning means, said slot having an enlarged central portion.

* * * * *